US006579169B1

(12) United States Patent
Demark

(10) Patent No.: US 6,579,169 B1
(45) Date of Patent: Jun. 17, 2003

(54) WINDOW FAN ASSEMBLY

(75) Inventor: Kenneth Raymond Demark, Bloomfield Hills, MI (US)

(73) Assignee: Bold Technologies, Inc., Troy, MI (US)

( * ) Notice: Subject to any disclaimer, the term of this patent is extended or adjusted under 35 U.S.C. 154(b) by 0 days.

(21) Appl. No.: 10/190,910

(22) Filed: Jul. 8, 2002

(51) Int. Cl.[7] ..... E06B 7/02
(52) U.S. Cl. ..... 454/208; 454/200
(58) Field of Search ..... 454/208, 225, 454/200; 52/204.6, 204.51, 209

(56) References Cited

U.S. PATENT DOCUMENTS

| | | | | | |
|---|---|---|---|---|---|
| 2,011,419 | A | * | 8/1935 | Ross | 454/208 |
| 2,039,346 | A | * | 5/1936 | Reed | 454/208 |
| 2,039,970 | A | * | 5/1936 | McLaughlin | 454/208 |
| 2,268,801 | A | * | 1/1942 | Carlton | 454/208 |
| 2,316,634 | A | * | 4/1943 | Spear | 454/208 |
| 2,456,340 | A | * | 12/1948 | Tideman | 454/208 |
| 2,529,040 | A | * | 11/1950 | Morrison | 454/208 |
| 2,729,389 | A | * | 1/1956 | Koch | 415/60 |
| 2,804,817 | A | * | 9/1957 | Delf et al. | 454/208 |
| 2,885,946 | A | * | 5/1959 | Loreto | 454/208 |
| 4,073,224 | A | * | 2/1978 | Bierlich | 454/213 |
| 5,296,678 | A | * | 3/1994 | Schnorf | 219/203 |
| 5,675,948 | A | | 10/1997 | Boesch | |

OTHER PUBLICATIONS

Glass Block Ventilators, Great Lakes Glass Block, Toledo, Ohio.

* cited by examiner

*Primary Examiner*—Derek Boles
(74) *Attorney, Agent, or Firm*—Carlson, Gaskey & Olds

(57) ABSTRACT

A window assembly comprises a frame into which is removably mounted a fan assembly. The fan assembly includes at least one fan mounted in an opening through a mounting plate. The mounting plate is removably secured to the window assembly by a screen, which is removably secured to the window frame. The inventive window assembly is particularly useful for existing glass block window and vent designs.

18 Claims, 3 Drawing Sheets

WINDOW FAN ASSEMBLY

BACKGROUND OF THE INVENTION

The present invention relates generally to fans and more particularly to a window fan assembly which easily can be installed and removed from an existing window assembly and can be closed inside the window assembly.

Glass block windows are well known and also used in basement windows and other areas where security is a concern. Generally, an array of glass blocks are arranged within the window opening in the basement wall and secured to each other and to the basement wall using mortar and or adhesive. Often, a small vent is substituted for one or more of the glass blocks to selectively provide ventilation through the glass block window assembly. These vents typically comprise a frame to which a screen is removably secured to the exterior side, while a window connected via a hinge on the interior side of the frame. The window is opened and closed by pivoting about the hinge.

Although these vents provide some ventilation, it is difficult to use these vents with fans to provide forced air ventilation. An existing design provides a power vent, which comprises a frame with two fans mounted therein; however, this power vent does not transmit light. Additionally, the known power vent must be installed in place of a normal window vent assembly at the time of installation of the glass blocks and the fans cannot be selectively removed from the frame. Thus, even when not in use, the known power vent blocks the passage of light through the frame.

SUMMARY OF THE INVENTION

The present invention provides an improved fan assembly for a vent of the type described above. The fan assembly of the present invention can be installed in an existing vent and can be selectively removed and reinstalled. Further, the fan assembly of the present invention also provides passage of light therethrough.

The fan assembly of the present invention comprises at least one fan mounted over an opening through a translucent mounting plate. The mounting plate is removably installed in the existing vent assembly, where it resides between the screen and window. Preferably, the mounting plate is secured between the frame and the screen, thereby securing the fan assembly to the frame.

DETAILED DESCRIPTION OF THE PREFERRED EMBODIMENT

Figure 1:
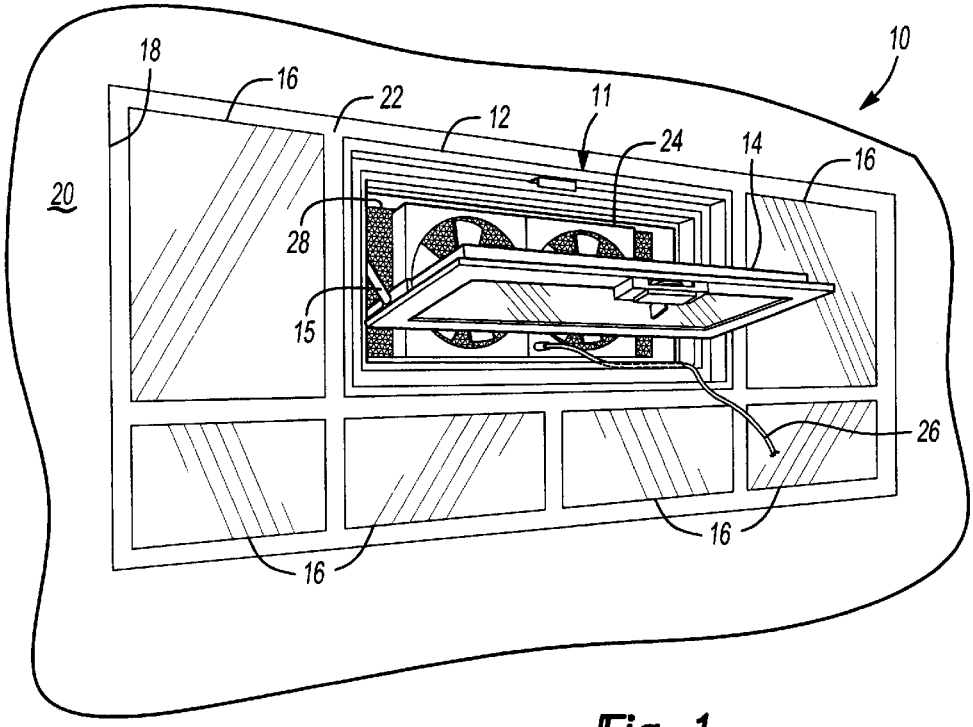
FIG. 1 illustrates the window assembly of the present invention.

FIG. 1 illustrates the window and fan assembly 10 of the present invention. A vent assembly 11 comprises a window frame 12 connected to a window 14 by a plurality of hinges 15 (one shown), such that the window 14 can be moved between the open position shown to a closed position against the frame 12. The window frame 12 is mounted among an array of glass blocks 16, which as shown can be of varying shapes and sizes. The glass blocks 16 are generally approximately three inches thick and made of a translucent or transparent material. The window frame 12 and glass blocks 16 are mounted in an opening 18 of a basement wall 20 and secured to each other and to the basement wall 20 by mortar or adhesive 22. Such window assemblies are well known and popular for use as basement windows and other exterior window applications.

The present invention further provides a fan assembly 24 in the frame 12 between the window 14 and a screen 28. A power cord 26 extends from the fan assembly 24 inward through the frame 12. In the example shown, the fan assembly 24 provides power ventilation to an existing glass block 16 and vent assembly 11. The fan assembly 24 can be selectively installed in and removed from the vent assembly 11.

Figure 2:
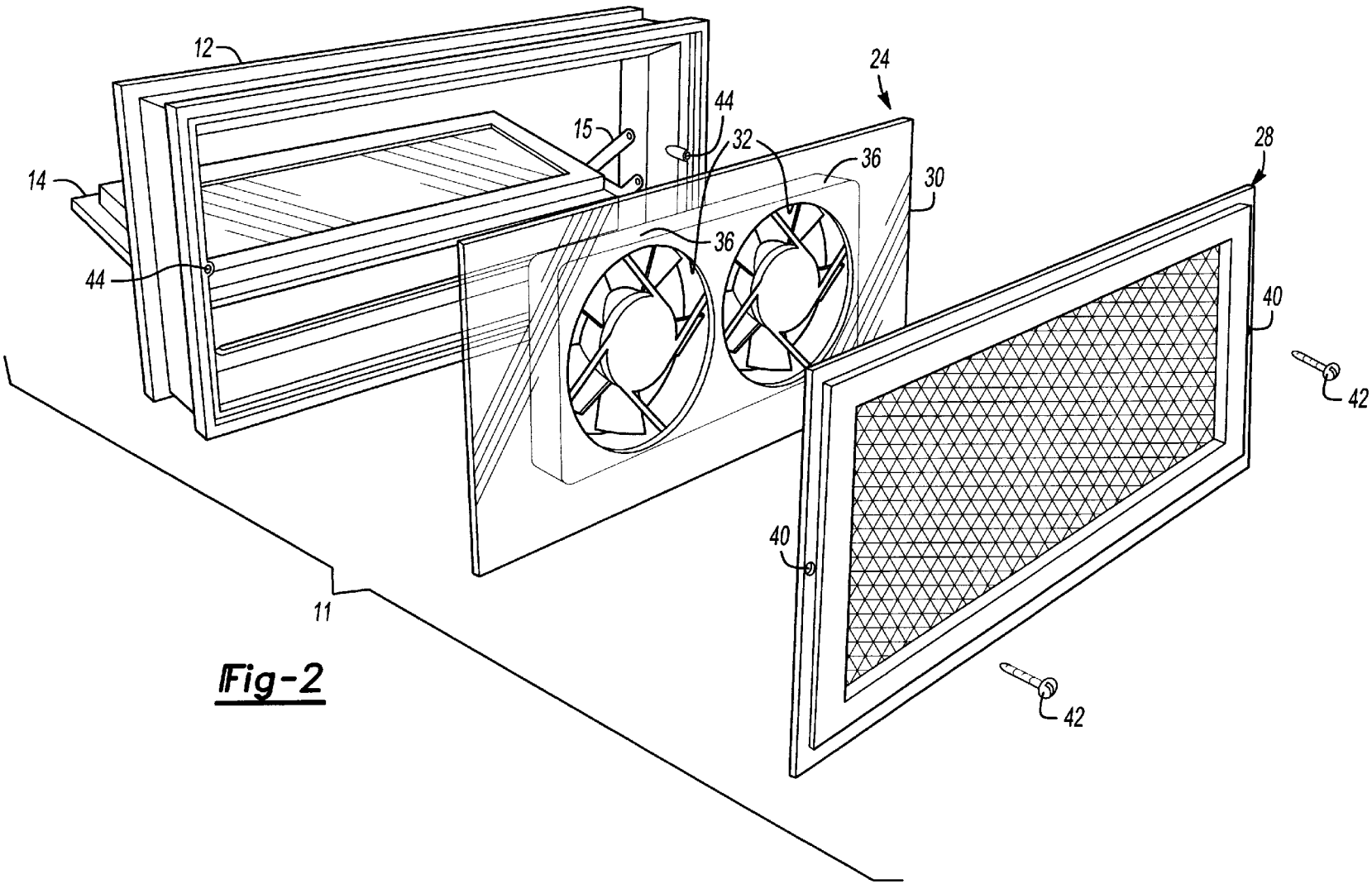
FIG. 2 is a partially exploded perspective view of the window assembly of FIG. 1.

The vent assembly 11 and fan assembly 24 are shown in more detail in FIG. 2. As shown, the fan assembly 24 generally comprises a translucent or transparent mounting plate 30 having two circular openings 32. Two fans 36 are mounted to the mounting plate 30, one over each of the openings 32. The fans 36 are preferably DC operated fans of the type generally used in cooling computers, for example. The mounting plate 30 is preferably transparent or translucent plastic. The mounting plate 30 is sized to be received partially within the frame 12, as will be explained further below, and is positioned between the screen 28 and the frame 12. The screen 28 includes at least a pair of apertures 40 for receiving screws 42, which in turn also mate with threaded apertures 44 on frame 12.

Figure 3:
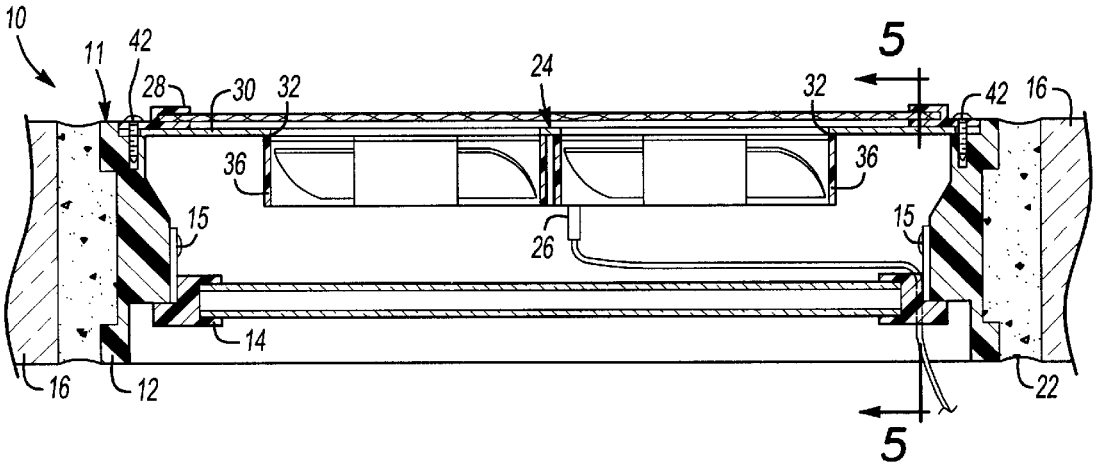
FIG. 3 is a section horizontally through the window assembly of FIG. 3.

FIG. 3 is a sectional view of the assembled window assembly 10, with the window 14 in the closed position, sealed against frame 12. As can be seen in FIG. 3, the mounting plate 30 is retained between the screen 28 and the frame 12 adjacent the screws 42. In this position, the power cord 26 may extend inward between the window 14 and the frame 12 if a notch (not shown) were cut in the window frame. Alternatively, it is recommended that the power cord 26 be disconnected from the fans 36 prior to closing window 14. In either case, the fan assembly 24 is installed in the window assembly 10 without modifying or damaging any of the prior installed components. The window 14 can be closed in a normal manner. Additionally, light can travel through mounting plate 30 (and to some extent, through fans 36) and through window 14, such that fan assembly 24 does not block the transmission of light from the outside.

Figure 4:
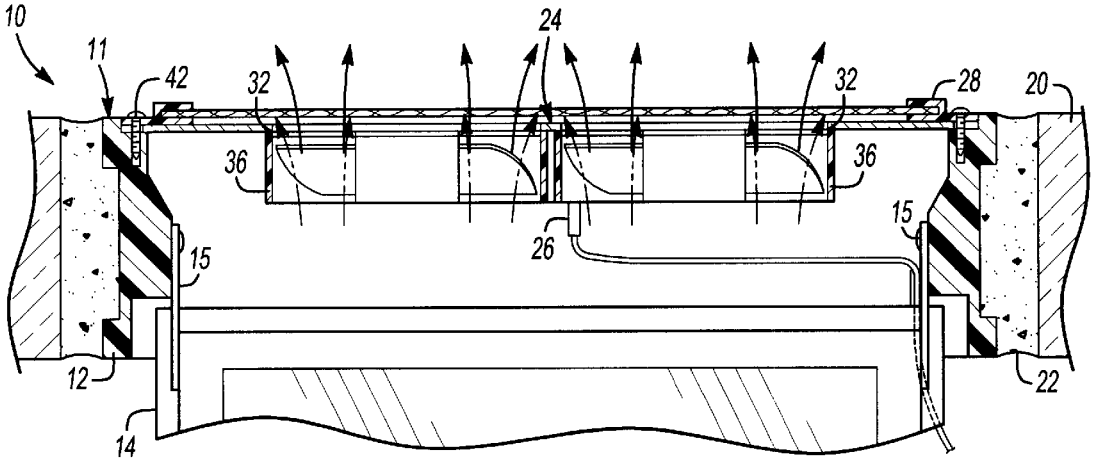
FIG. 4 is the window assembly of FIG. 3, with the window in an open position.
Figure 5:
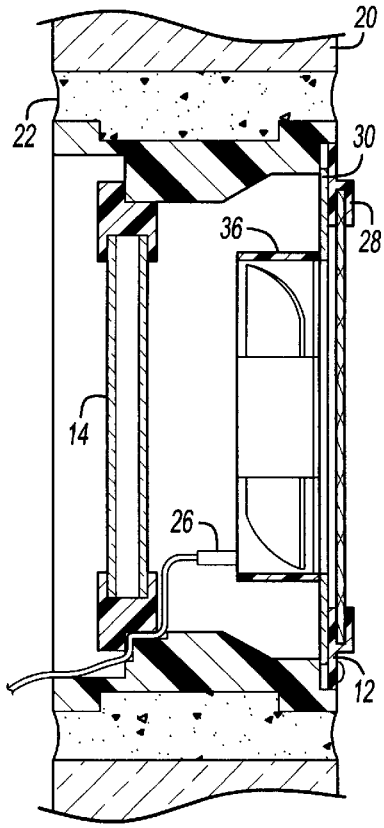
FIG. 5 is a section through 5—5 of FIG. 3.

FIG. 4 illustrates the window assembly 10 in operation. Window 14 is pivoted on hinge 15 to the open position away from the frame 12 in a known manner. The fans 36 are then powered and the fan assembly 24 draws air from the interior out through frame 12 and through the openings 32 in the mounting plate 30 and subsequently through screen 28. Of course, the fans 36 could be arranged to draw air inward through vent assembly 11, or could be selectively reversable. Again, during operation of the fan assembly 24, the vent assembly is not damaged or modified and light can still travel through mounting plate 30 and through frame 12. After use, the fans 36 are switched off and/or power cord 26 is disconnected and window 14 may be returned to the closed position sealed against frame 12, as shown again in FIG. 5. As can be seen in FIG. 5, the mounting plate 30 is also held on the top and bottom edges between the screen 28 and frame 12. Further, as can be seen in FIG. 5, the power cord 26 may extend between the window 14 and the frame 12.

As shown, the fan assembly 24 of the present invention is mountable between the screen 28 and window 14 of a typical glass block vent assembly 11. The fan assembly 24 does not interfere with the closing and locking of the window 14. Further, the translucent or transparent mounting plate 30 allows for the passage of light through the vent assembly 11. The fan assembly 24 is light-weight and includes a "pull-away" power cord which would be pulled out from the fan without damaging the fan assembly 24 or power cord 26 in the event that someone inadvertently kicks or pulls on the power cord 26.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, although the invention has been described with respect to glass block windows, the fan assembly 24 of the present invention may be installed in windows other than glass block windows. An alternative fan assembly which is integrated with the screen such that the integrated screen and fan assembly could be mounted in place of the screen 40 (see FIG. 2, for example) is also considered to be within the scope of this invention. It should also be noted that the term "translucent" as used herein includes anything that is translucent or transparent.

What is claimed is:

1. A window assembly comprising:

A plurality of translucent blocks;

A frame adjacent the plurality of blocks, the frame defining an opening therethrough;

A fan assembly removably mounted in the frame.

2. The window assembly of claim 1 further including a screen removably secured to the frame, a portion of the fan assembly being secured between the screen and the frame to retain the fan assembly in the frame.

3. The window assembly of claim 1 wherein the fan assembly includes at least one fan attached to a mounting plate, the mounting plate removably mounted in the frame.

4. The window assembly of claim 3 further including a screen removably secured to the frame, the mounting plate being removably mounted in the frame by the screen.

5. The window assembly of claim 4 wherein the mounting plate is removably mounted in the frame by being positioned between the screen and the frame.

6. The window assembly of claim 5 further including a window selectively movable from a closed position sealing the opening through the frame to an open position permitting airflow through the opening through the frame.

7. The window assembly of claim 6 wherein the plurality of blocks are mounted in an opening in a basement wall.

8. The window assembly of claim 7 wherein the mounting plate is translucent.

9. The window assembly of claim 8 wherein the at least one fan comprises at least two fans.

10. The window assembly of claim 9 wherein the at least one fan comprises at least one DC operated fan.

11. The window assembly of claim 10 further including a power cord extending from the at least one fan through the opening in the frame adjacent the window.

12. A method for installing a fan in a window assembly including the steps of:

a. Mounting a fan assembly into a frame, between a window and a screen;

b. Closing the window, thereby sealing the window to the frame, with the at least one fan positioned between the window and the screen;

c. Opening the window after steps a–b; and d. Powering the fan assembly after steps a–c.

13. The method of claim 12 wherein step a. further includes the step of securing a portion of the at least one fan assembly between the screen and the frame to retain the fan assembly in the frame.

14. The method of claim 12 wherein said frame is mounted among a plurality of translucent blocks.

15. The method of claim 14 wherein said plurality of translucent blocks are mounted in a basement wall.

16. The method of claim 12 wherein said step a. further includes the steps of:

e. removing the screen from the window assembly;

f. placing the fan assembly adjacent the frame;

g. reattaching the screen to the frame, thereby securing the screen and fan assembly to the frame.

17. A window fan assembly comprising:

A frame;

A window mounted to the frame;

A screen mounted to the frame;

A translucent mounting plate having at least one opening therethrough, the mounting plate mounted between a screen and a window; and At least one fan mounted in the at least one opening.

18. The window fan assembly of claim 17 wherein the mounting plate is held between the screen and the frame.

* * * * *